US005515830A

United States Patent [19]

Arakowa

[11] Patent Number: 5,515,830

[45] Date of Patent: May 14, 1996

[54] FUEL INJECTION EQUIPMENT FOR INTERNAL COMBUSTION ENGINE

[75] Inventor: Yoshinobu Arakowa, Numazu, Japan

[73] Assignee: Kokusan Denki Co., Ltd., Shizuoka, Japan

[21] Appl. No.: 445,671

[22] Filed: May 22, 1995

[51] Int. Cl.[6] ..... F02M 51/00

[52] U.S. Cl. ..... 123/490

[58] Field of Search ..... 123/490, 185.3; 137/1; 361/154, 155

[56] References Cited

U.S. PATENT DOCUMENTS

| | | | |
|---|---|---|---|
| 4,604,675 | 8/1986 | Pflederer | 361/155 |
| 5,053,911 | 10/1991 | Kopec et al. | 361/154 |
| 5,161,496 | 11/1992 | Matsushima et al. | 123/185.3 |
| 5,267,545 | 12/1993 | Kitson | 123/490 |
| 5,287,839 | 2/1994 | Kondou et al. | 123/478 |
| 5,402,760 | 4/1995 | Takeuchi et al. | 123/490 |
| 5,425,343 | 6/1995 | Akaki et al. | 123/490 |
| 5,442,515 | 8/1995 | Wallaert | 123/490 |

FOREIGN PATENT DOCUMENTS

| | | | |
|---|---|---|---|
| 54-264 | 1/1979 | Japan | 123/490 |
| 61-48624 | 1/1986 | Japan | 123/490 |
| 62-348 | 1/1987 | Japan | 123/490 |

*Primary Examiner*—Raymond A. Nelli

*Attorney, Agent, or Firm*—Pearne, Gordon, McCoy & Granger

[57] ABSTRACT

A fuel injection equipment for an internal combustion engine capable of reducing a variation in fuel injection time due to a variation in power supply voltage. An injector is incorporated which is constructed so as to exhibit characteristics which permit ineffective time consumed between start of flowing of an exciting current and actual opening of a valve to converge on a constant value while being gradually reduced with an increase in driving voltage. The driving voltage is set to be a value increased sufficient to permit a ratio of variation of the ineffective time to the driving voltage to be within a tolerance.

4 Claims, 4 Drawing Sheets

FUEL INJECTION EQUIPMENT FOR INTERNAL COMBUSTION ENGINE

BACKGROUND OF THE INVENTION

This invention relates to a fuel injection equipment for an internal combustion engine, and more particularly to a fuel injection equipment for feeding an internal combustion engine with fuel.

A fuel injection equipment for an internal combustion engine which has been conventionally used in the art, as shown in FIG. 5, generally includes an injector 1, a fuel injection command signal generation section 2, an injector driving circuit 3 and a power supply 4.

The injector 1, as shown in, for example, FIG. 6, includes a valve body 1*b* provided at a distal end thereof with a fuel injection port 1*a* a valve 1*c* including a valve seat 1*c*1 formed in an inner end of the fuel injection port 1*a* and a needle 1*c*2 arranged in the valve body 1*b* and operating the fuel injection port 1*a*, an electromagnet 1*f* including a plunger 1*d* connected to the needle 1*c*2 and an exciting coil 1*e* and openably actuating the valve 1*c*, and a return spring 1*g* for urging the plunger 1*d* to hold the valve 1*c* at a closed position. The valve body 1*b* is provided on a rear end side thereof with a fuel feed port 1*h*, which is connected to a fuel pump (not shown), so that fuel F is fed from the fuel pump through the fuel feed port 1*h* to the valve body 1*b* and therefor the injector 1 under a predetermined fuel feed pressure P.

In the injector 1 thus constructed, when a driving voltage is applied across the exciting coil 1*e* to feed an exciting current Id thereto, the plunger 1*d* is retracted into the exciting coil 1*e*, resulting in the valve 1*c* being actuated to open the fuel injection port 1*a*. The valve 1*c* is kept open until the electromagnet 1*f* is de-energized, during which fuel is outwardly ejected through the fuel injection port 1*a*.

The injection command signal generation section 2 comprises a microcomputer including, for example, a CPU, a ROM, a RAM and the like and is fed with an output of a signal source 5 for generating a signal containing information on a rotation angle of an internal combustion engine and that on an engine speed of the engine, as well as an output of various sensors 6 such as a temperature sensor, an atmospheric pressure sensor, a sensor for detecting a degree of opening of a throttle and the like, to thereby operate a fuel injection start position θj and a signal width Tj of an injection command signal required for ejecting predetermined fuel, resulting in generating an injection command signal Vj of a rectangular waveform having the signal width Tj at the fuel injection start position θj thus operated.

The injector driving circuit 3 functions to flow an exciting current Id through the exciting coil 1*e* of the injector 1 during a period of time for which the injection command signal Vj is generated. For this purpose, the injector driving circuit 3 includes a switch circuit 3*a* constituted by a semiconductor element such as a transistor Tr or the like. The switch circuit 3*a* is connected in series to the exciting coil 1*e* of the injector 1, so that the diving voltage Vd generated from the power supply 4 may be applied through a resistor 7 across a serial circuit constituted by the exciting coil 1*e* and switch circuit 3*a*.

In the conventional fuel injection equipment constructed as described above, when the injection command signal generation section 2 generates an injection command signal Vj, the switch circuit 3*a* of the injector driving circuit 3 is caused to be turned on to flow an exciting current Id through the exciting coil 1*e* of the injector 1. FIG. 7 shows a variation in exciting current Id to time t, wherein curves a and b indicate characteristics obtained when the driving voltage Vd is Vd1 and Vd2 (<Vd1), respectively. Also, in FIG. 7, t1 indicates time at which the valve of the injector is rendered open when the driving voltage Vd is Vd1 and t2 indicates time at which the valve is open when the voltage Vd is Vd2.

As will be noted from FIG. 7, the injector for the internal combustion engine wherein the valve is actuated by the electromagnet causes a significant length of ineffective time to be consumed between start of flowing of an electric current through the exciting coil and actual opening of the valve. Thus, fuel injection is delayed until time t1 or t2 at which the valve is rendered open elapses after the exciting coil is fed with electricity. Thus, of the signal width Tj of the injection command signal, a period of time between start of flowing of the exciting current Id through the exciting coil and actual opening of the valve of the injector is ineffective time Tm and a period of time during which the valve is kept open is effective time Ta.

The ineffective time Tm is increased with a decrease in driving voltage Vd. In order to accurately control a feed rate of fuel fed to the internal combustion engine, it is required to minimize a variation of the ineffective time Tm to a variation of the driving voltage Vd. Unfortunately, the convention fuel injection equipment causes the ineffective time Tm to be substantially varied with respect to the driving voltage Vd. Thus, in order to permit accuracy of the injector to be within a tolerance, it is required to arrange a voltage detection circuit 8 for detecting the driving voltage Vd to correct the signal width Tj (=Tm+Ta) of the injection command signal Vj depending on an output of the voltage detection circuit 8.

In the conventional fuel injection equipment shown in FIG. 5, the injector 1 is so constructed that rising of the exciting current Id is relatively delayed and a saturation value thereof is relatively low, so that it is not required to carry out control for restricting a magnitude of the exciting current Id. However, such an injector causes the ineffective time Tm to be increased, resulting in a variation in ineffective time Tm to a variation in driving voltage Vd being increased.

On the contrary, when an injector wherein rising of the exciting current is rapid and a saturation value thereof is increased is incorporated in a fuel injection equipment, the ineffective time Tm is relatively reduced and a variation in ineffective time Tm to a variation in driving voltage Vd is reduced.

FIG. 8 shows another conventional fuel injection equipment for an internal combustion engine in which such an injector as described above wherein rising of the exciting current Id is rapid is incorporated. The fuel injection equipment is so constructed that a resistor 3*b* for current detection is connected in series to a collector-emitter circuit of a transistor constituting a switch circuit 3*a* of an injector driving circuit 3 and a current detection signal Vi produced across the resistor 3*b* is fed to a current control circuit 3*c*.

The current control circuit 3*c* functions to flow a current through a base of a transistor Tr to turn on the transistor when it is fed with an injection command signal Vj. Also, it functions to limit a magnitude of a current fed to the base of the transistor Tr to hold the exciting current Id at a constant holding current Ido when the current detection signal Vi reaches a set value Ido. The holding current Ido required for permitting a valve of the injector which has been rendered open to be kept open may be set to be a value lower than a maximum value of the exciting current generated prior to opening of the valve.

FIG. 9 shows a variation in exciting current Id with time in the fuel injection equipment shown in FIG. 8. In FIG. 9, curves a and b indicate characteristics obtained when the driving voltage Vd is Vd1 and Vd2 (<Vd1), respectively. Also, in FIG. 9, t1' indicates time at which the valve of the injector is rendered open when the driving voltage Vd is Vd1 and t2' indicates time at which the valve is open when the voltage Vd is Vd2.

As will be noted from FIG. 9, even when the injector wherein rising of the exciting current is rapid and the ineffective time Tm is relatively reduced is incorporated in the fuel injection equipment, a variation of the ineffective time Tm to the driving voltage Vd is likewise relatively increased, so that it is still required to correct the fuel injection time Tj (=Tm+Ta) depending on the driving voltage Vd detected.

As described above, the conventional fuel injection equipment causes the ineffective time Tm between feeding of the injection command signal and actual opening of the valve to be substantially varied when the driving voltage Vd of the injector is varied. Thus, in order to accurately control a feed rate of fuel fed to the internal combustion engine, it is required to correct the signal width Tj of the injection command signal Vj with respect to the driving voltage Vd. Unfortunately, this requires a complicated operation for the correction, to thereby cause a time length for the correction to be substantially increased.

Also, when any ripple is contained in the driving voltage Vd in the case that the driving voltage Vd is to be detected for correction of the signal width Tj, a value of the voltage detected is caused to be varied depending on a timing at which the voltage is detected, resulting in the quantity of correction being varied, leading to a failure in accurate correction.

It would be considered that a battery of an increased capacity is used to reduce the ripple of the driving voltage. Unfortunately, such a battery causes a weight of the internal combustion engine to be significantly increased to a degree sufficient to deteriorate a fuel consumption rate of the engine.

Further, it would be considered that a smoothing capacitor is connected to a circuit for detecting the driving voltage to eliminate the ripple. However, connection of the smoothing capacitor deteriorates responsibility of the equipment.

Moreover, averaging of a detection value of the driving voltage would be considered for sampling. However, this likewise deteriorates the responsibility.

SUMMARY OF THE INVENTION

The present invention has been made in view of the foregoing disadvantage of the prior art.

Accordingly, it is an object of the present invention to provide a fuel injection equipment for an internal combustion engine which is capable of significantly reducing a variation in rate of injection of fuel without requiring any operation for correction of a signal width of an injection command signal.

In accordance with the present invention, a fuel injection equipment for an internal combustion engine is provided. The fuel injection equipment includes an injector including a valve for operating a fuel injection port and an electromagnet for openably actuating the valve and constructed so as to exhibit characteristics which permit ineffective time consumed between start of flowing of an exciting current and actual opening of the valve to converge on a constant value while being gradually reduced with an increase in driving voltage, and a power supply for applying the driving voltage across an exciting coil of the electromagnet of the injector. The driving voltage is set at a high level enough to permit a ratio of variation of the ineffective time to the driving voltage to be within a tolerance. The fuel injection equipment also includes an injection command signal generation section for generating an injection command signal of a predetermined signal width at a fuel injection start position and an injector driving circuit for flowing the exciting current through the exciting coil for a period of time during which the injection command signal is generated.

In a preferred embodiment of the present invention, the power supply comprises a generating coil provided in a magneto mounted on the internal combustion engine and a voltage control circuit including a rectifying circuit for rectifying an output of the generating coil and functioning to control the driving voltage.

In a preferred embodiment of the present invention, the power supply comprises a generating coil provided in a magneto mounted on the internal combustion engine and a rectifying circuit for rectifying an output of the generating coil.

In a preferred embodiment of the present invention, the driving voltage is set to be 23 V or more.

In a preferred embodiment of the present invention, the tolerance is set to be 0.03 msec/V or less.

In a preferred embodiment of the present invention, the injection command signal generation section comprises a main injection command signal generation section for generating a main injection command signal using a microcomputer, an auxiliary injection command signal generation section for generating an auxiliary injection command signal when the microcomputer fails to normally operate, and a switching circuit for selecting the signals generated from the main injection command signal generation section and auxiliary injection command signal generation section to generate the injection command signal therefrom.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a fuel injection equipment for an internal combustion engine according to the present invention will be described hereinafter with reference to the accompanying drawings.

Figure 1:
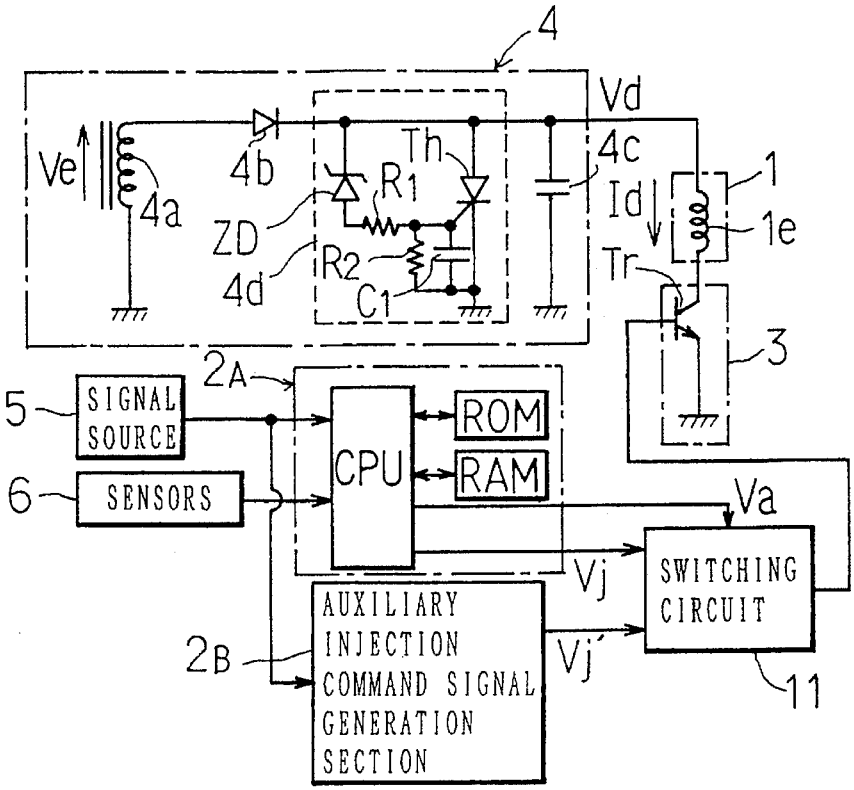
FIG. 1 is a circuit diagram showing an embodiment of a fuel injection equipment for an internal combustion engine according to the present invention.
Figure 6:
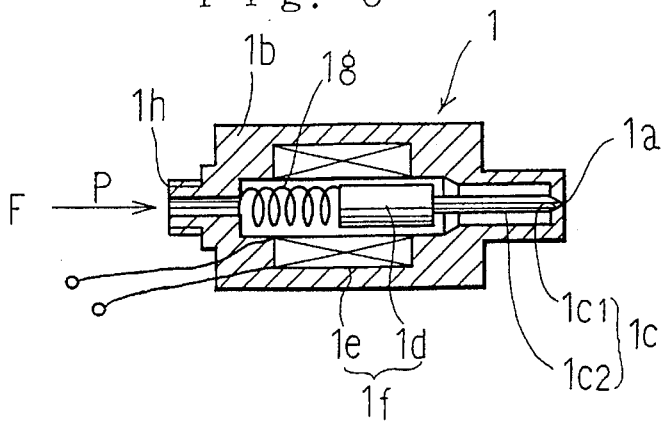
FIG. 6 is a sectional view showing an injector.
Figure 7:
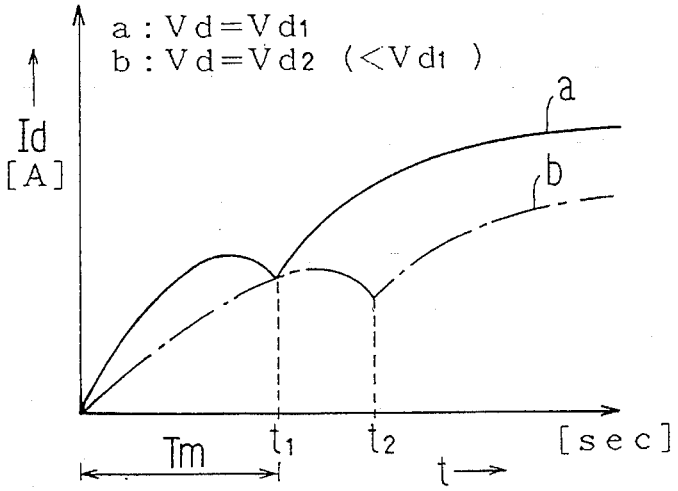
FIG. 7 is a graphical representation showing an example of a variation of an exciting current of an injector with time in the conventional fuel injection equipment of FIG. 5.
Figure 8:
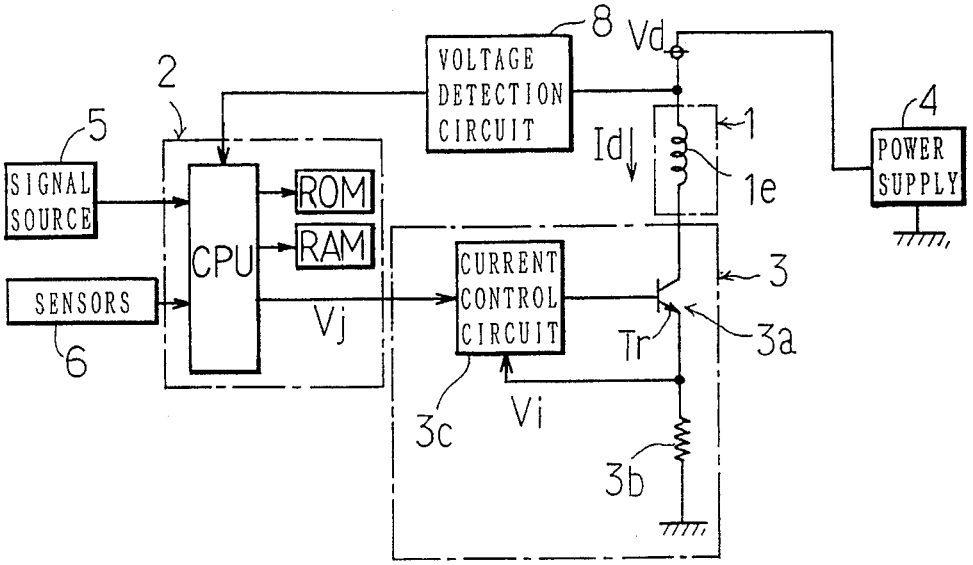
FIG. 8 is a circuit diagram showing another conventional fuel injection equipment for an internal combustion engine.
Figure 9:
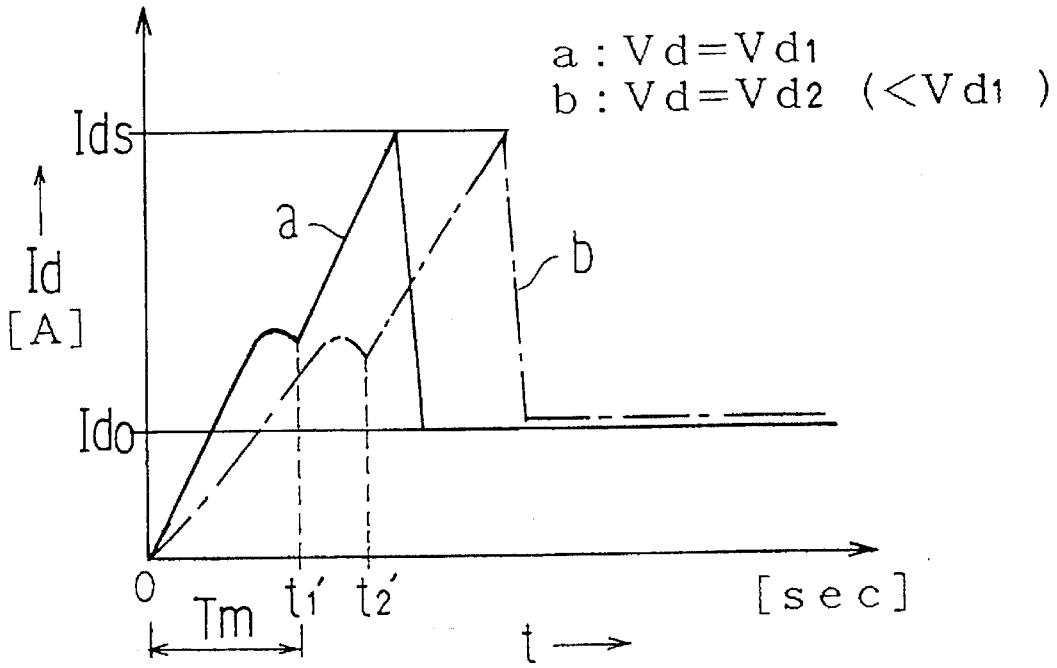
FIG. 9 is a graphical representation showing an example of a variation of an exciting current of an injector with time in the conventional fuel injection equipment of FIG. 8.

Referring first to FIG. 1, an embodiment of a fuel injection equipment for an internal combustion engine according to the present invention is illustrated. In FIG. 1, reference numeral 1 designates an injector which may be constructed in a manner similar to the conventional injector described above with reference to FIG. 6. Thus, the injector 1 includes a valve 1*c* for operating a fuel injection port 1*a* and an electromagnet 1*f* for actuating the valve 1*c*. 2A is a main injection command signal generation section which comprises a microcomputer and is adapted to generate a main injection command signal Vj of a predetermined signal width Tj at a fuel injection start position, 2B is an auxiliary injection command signal generation section for generating an auxiliary injection command signal Vj' when the microcomputer falls into a state of failing to normally operate, 3 is an injector driving circuit for flowing an exciting current through an excitation coil 1*e* of the injector 1, 4 is a power supply for applying a driving voltage Vd to the excitation coil 1*e* of the injector 1, and 1*l* is a switching circuit for selecting any one of the main injection command signal Vj and auxiliary injection command signal Vj' to feed it to the injector driving circuit 3.

In the illustrated embodiment, the power supply 4 includes a generating coil 4*a*, a power capacitor 4*c* charged through a diode 4*b* by means of an output voltage Vc of the generating coil 4*a* and a voltage control circuit 4*d* for restricting a voltage across the capacitor 4*c* to a predetermined level or below. In the illustrated embodiment, the voltage control circuit 4*d* includes a thyristor Th connected in parallel across the capacitor 4*c*, a Zener diode ZD connected between an anode of the thyristor Th and a gate thereof through a resistor R1, and a resistor R2 and a capacitor C1 each connected in parallel between the gate of the thyristor Th and a cathode thereof. In the voltage control circuit thus constructed, when a voltage across the capacitor 4*c* reaches a predetermined level, the thyristor Th is fed with a trigger signal through the Zener diode ZD. Thus, the thyristor Th is made conductive to block charging of the capacitor 4*c* every time when a voltage across the capacitor 4*c* reaches the predetermined level, resulting in the voltage being limited to the predetermined level or below.

The main injection command signal generation section 2A comprises a microcomputer equipped with a CPU, a ROM, a RAM and the like and is fed with an output of a signal source 5 for generating a signal containing information on an rotation angle of an internal combustion engine and an output of each of various sensors 6 such as a temperature sensor, an atmospheric pressure sensor, a sensor for sensing or detecting a degree of opening of a throttle and the like, to thereby operate a fuel injection start position θj and a signal width Tj of an injection command signal required for ejecting predetermined fuel, leading to generation of a main injection command signal Vj of a rectangular waveform having the signal width Tj at the fuel injection start position θj thus operated.

The auxiliary injection command signal generation section 2B comprises a hardware circuit and is fed with an output of the signal source 5, to thereby generate an auxiliary injection command signal Vj' of a predetermined signal width. The auxiliary injection command signal generation section 2B may be constituted by, for example, a monostable multivibrator which is triggered when the signal source 5 generates a predetermined signal, to thereby generate a signal of a rectangular waveform. The auxiliary injection command signal generation section 2B is driven by an output of the power supply 4.

The injector driving circuit 3 includes a switch circuit using an NPN transistor Tr, wherein a circuit between a collector of the transistor Tr and an emitter thereof is connected in series to the excitation coil 1*e* of the injector 1.

The switching circuit 1*l* includes a relay or semiconductor switch circuit, which functions to feed a current of a predetermined magnitude to a base of the transistor for a period of time during which the main injection command signal Vj is generated when it is fed with a change-over command signal Va from a CPU of the microcomputer, to thereby turn on the transistor Tr and feed the predetermined current to the base of the transistor Tr for a period of time during which the auxiliary injection command signal Vj' is generated when it is not fed with the change-over command signal Va, to thereby turn on the transistor Tr.

A program for operating the microcomputer constituting the main injection command signal generation section 2A has a check program for checking operation of the microcomputer incorporated therein. The check program functions to cause the CPU to generate a change-over signal Va of a high level when the check program judges that the microcomputer normally operates and prevent the CPU from generating the change-over command signal Va when it judges that the microcomputer fails to normally operate or that a voltage output from the power supply 4 does not reach a level sufficient to stably operate the microcomputer at the time of starting of the engine or the microcomputer is out of order.

Thus, at the time of starting of the engine at which a voltage of the power supply 4 does not reach to a level sufficient to stably operate the microcomputer or when the microcomputer is out of order, the transistor Tr is kept turned on for a period of time during which the auxiliary injection command signal generation section 2B generates the auxiliary injection command signal Vj', resulting in an exciting current Id being fed to the exciting coil 1*e* of the injector 1, so that the transistor Tr is turned on to feed the exciting current Id to the exciting coil 1*e* of the injector 1 for a period of time during which the main injection command signal generation section 2A generates a main injection command signal Vj when the microcomputer is at a steady state or normally operates.

Figure 2:
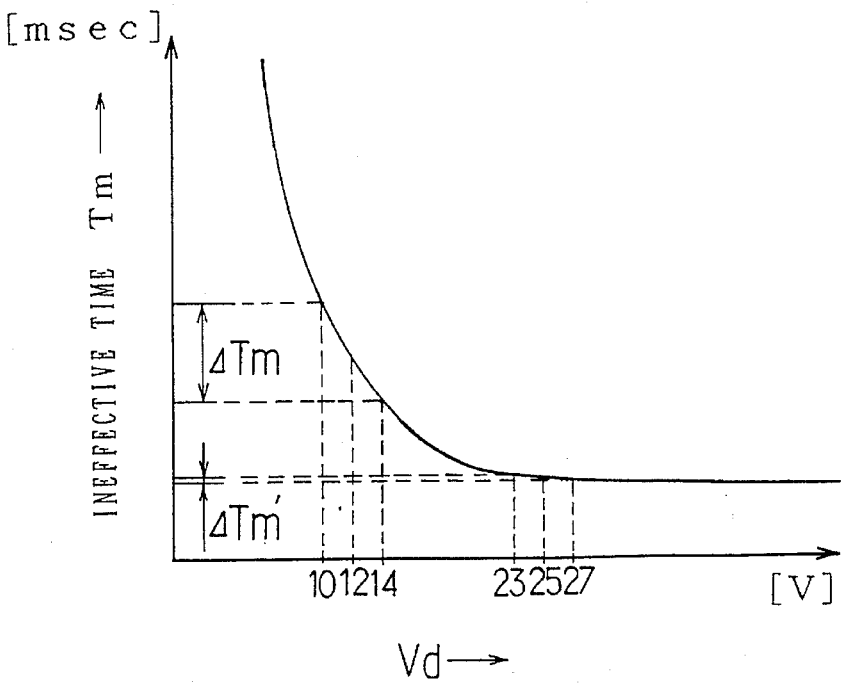
FIG. 2 is a graphical representation showing relationship between ineffective time of an injector and a driving voltage thereof.

As a result of various experiments made by the inventor, it was found that an injector in which a valve is operated by an electromagnet exhibits characteristics which permit ineffective time Tm consumed between application of a driving voltage Vd across an exciting coil of the injector and actual opening of the valve to converge on a constant value while being gradually reduced with an increase in driving voltage Vd. FIG. 2 shows one example of relationship between the ineffective time Tm of the injector and the driving voltage Vd, wherein the driving voltage Vd of 23 V or more causes a variation of the ineffective time Tm to the driving voltage to be substantially slight.

In view of such characteristics of the injector as described above, the present invention is so constructed that the ineffective time Tm is set at a high value within a range which permits the ineffective time Tm to substantially converge, resulting in a variation in ineffective time Tm to a variation in driving voltage Vd being within a tolerance.

In the conventional fuel injection equipment for the internal combustion engine, a rated value of the driving voltage Vd of the injector 1 is set at 12 V which is a rated voltage of the battery. However, this causes even a slight variation in driving voltage Vd to substantially vary the ineffective time Tm, because a region in which the driving voltage Vd is about 12 V causes a variation in ineffective time Tm to be highly increased as is apparent from FIG. 2. For example, supposing that effective time Ta at which fuel is actually ejected is 1 msec and the driving voltage Vd is varied within a range of ±2 V about 12 V, a variation width ΔTm of the ineffective time Tm or a width in which the ineffective time Tm is varied is about 0.4 msec, so that a ratio of variation of the ineffective time Tm to the effective time Ta is as high as 40%. Thus, in the prior art, it is required to detect the driving voltage Vd to correct a signal width Tj (=Tm+Ta) of the injection command signal Vj depending on a variation in driving voltage Vd in order to compensate a variation in ineffective time Tm.

Whereas, supposing that in the example of FIG. 2, the effective time Ta is 1 msec and a rated value of the driving voltage Vd is set to be, for example, 25 V, a variation width Tm' of the ineffective time Tm' is 0.03 msec. Thus, a ratio of a variation width of the ineffective time Tm' to the effective time Ta is as low as 3%, which is within a tolerance.

Figure 3A:
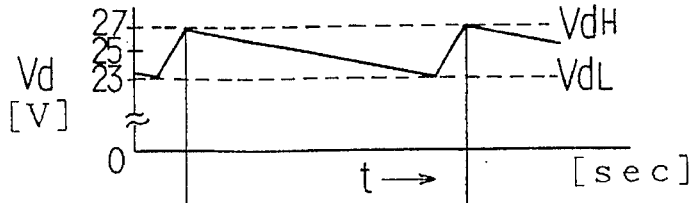
FIGS. 3(A) and 3(B) are waveform charts showing a waveform of a driving voltage and a waveform of an output voltage of a generating coil which are obtained in the fuel injection equipment of FIG. 1, respectively.
Figure 3B:
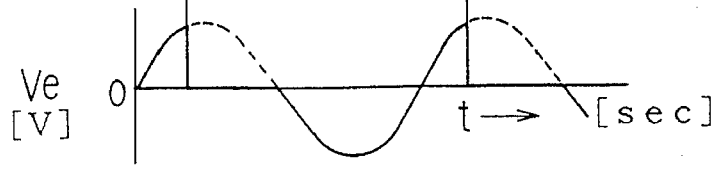

FIGS. 3(A) and 3(B) schematically show waveforms of a driving voltage (voltage across the capacitor 4*c*) and an output voltage Vc of the generating coil 4*a* obtained when the power supply 4 is provided with the voltage control circuit 4*d* as in FIG. 1, respectively. As shown in FIG. 3(A), the driving voltage Vd has a waveform varied between an upper limit value VdH thereof and a lower limit value VdL thereof. A portion of the output waveform of the generating coil 4*a* indicated at broken lines in FIG. 3(B) is that short-circuited by the thyristor Th. Arrangement of the voltage control circuit 4*d* causes the upper limit value VdH of the driving voltage Vd induced across the capacitor 4*c* to be limited to a constant level, so that the variation width VdH−VdL of the driving voltage Vd is restricted within a narrow range. Supposing that control is so carried out that the upper and lower limit values VdH and VdL are 27 V and 23 V, respectively, the driving voltage Vd is caused to be varied within a range of ±2 V about 25 V, thus, a ratio of the ineffective time Tm to the variation time Ta is 3% as in the example described above.

Figure 4A:
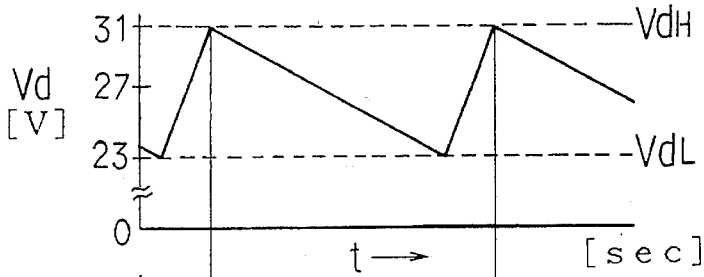
FIGS. 4(A) and 4(B) are waveform charts showing a waveform of a driving voltage and a waveform of an output voltage of a generating coil obtained in the fuel injection equipment of FIG. 1 from which a voltage control circuit is deleted, respectively.
Figure 4B:
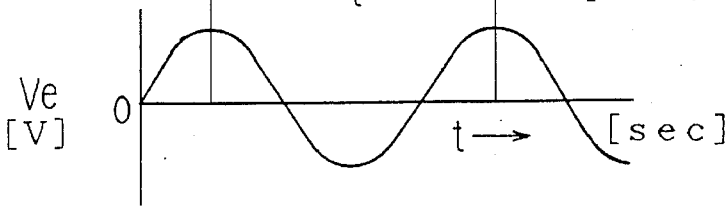
Figure 5:
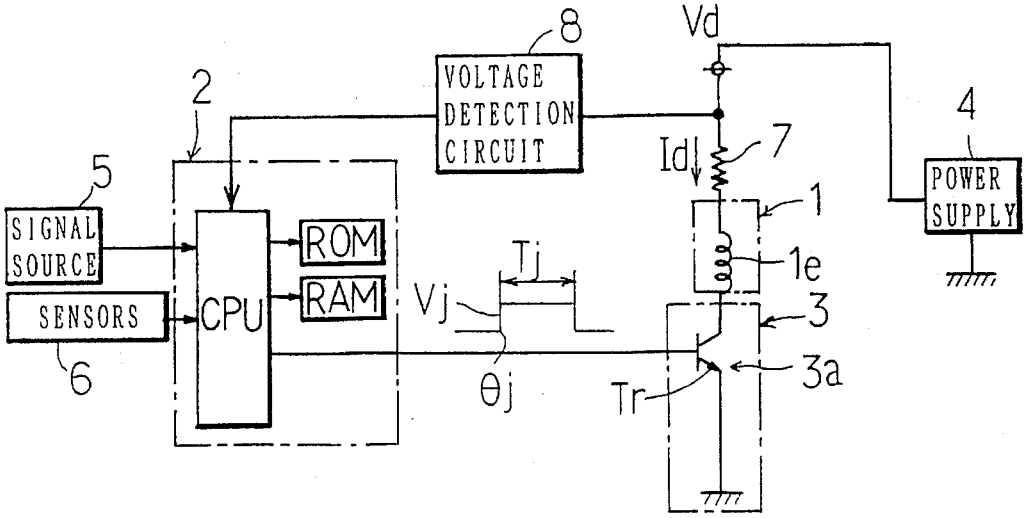
FIG. 5 is a circuit diagram showing a conventional fuel injection equipment for an internal combustion engine.

When the voltage control circuit 4*d* is deleted from the embodiment shown in FIG. 1, resulting in the power capacitor 4*c* being charged through the diode 4*b* by means of an output voltage Ve of the generating coil 4*a*, the driving voltage Vd and the output voltage of the generating coil 4*a* obtained at a certain engine speed have such waveforms as shown in FIGS. 4(A) and 4(B), respectively, so that the driving voltage Vd has an upper limit value VdH of, for example, 3 V and is varied within a range of ±4 V about 27 V. Irrespective of such an increase in variation width of the driving voltage, the injector may be accurately operated while eliminating an operation for correction of the signal width of the injection command signal, because a variation width of the ineffective time is highly reduced when a rated value of the driving voltage Vd is within a range which permits the ineffective time Tm to be substantially converge.

Thus, the present invention is so constructed that the driving voltage of the injector is set at a sufficiently high level in a range which permits the ineffective time Tm to substantially converge, resulting in a width of variation in ineffective time occurring when the driving voltage is varied being within a predetermined tolerance, so that the injector may be accurately operated while eliminating a necessity of correcting the signal width Tj of the injection command signal in view of a variation in driving voltage. This eliminates an operation for correcting the signal width Tj with respect to the driving voltage Vd, to thereby simplify a program for operating the signal width of the injection command signal.

In particular, when the auxiliary injection command signal generation section 2B is provided as in the illustrated embodiment, it is generally difficult to correct the signal width of the injection command signal with respect to a variation in driving voltage in the auxiliary injection command signal generation section. On the contrary, the present invention eliminates a necessity of correcting the injection command signal as described above, so that the injector may be operated with high accuracy irrespective of a variation in power supply voltage even when the injector is driven by the injection command signal generated from the injection command signal generation section comprising a hardware circuit.

The fuel injection equipment of the illustrated embodiment is suitable for use for an internal combustion engine for a vehicle which does not have a battery mounted thereon or the like, because it is driven by an output of a magneto. When the injector is thus driven by an output of a magneto, an output of the power supply 4 can be set freely as desired, so that setting of a rated value of the driving voltage Vd may be facilitated.

Also, the present invention may be likewise applied to a fuel injection equipment using a battery as a power supply. When the injector having such characteristics as shown in FIG. 2 is driven using a battery as a power supply therefor, a battery having a rated voltage of 24 V may be used for this purpose.

The above description has been made on, by way of example, the fuel injection equipment including the main injection command signal generation section using a microcomputer and the auxiliary injection command signal generation section comprising a hardware circuit. However, it is a matter of course that the present invention may be suitably applied to a fuel injection equipment in which only any one of an injection command signal generation section using a microcomputer and that comprising a hardware circuit is incorporated.

As can be seen from the foregoing, in the present invention, the injector adapted to exhibit characteristics which permit the ineffective time Tm consumed between start of flowing of an exciting current and actual opening of the valve to converge on a fixed value while being gradually reduced with an increase in driving voltage Vd is incorporated in the fuel injection equipment and the driving voltage Vd is set at a highly increased value, to thereby permit a ratio of variation of the ineffective time Tm to the driving voltage Vd to be within a predetermined tolerance. Such construction of the present invention eliminates an operation for correction of the signal width of the injection command signal, resulting in the injection command signal generation section being simplified in structure.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A fuel injection equipment for an internal combustion engine, comprising:

an injector including a valve for operating a fuel injection port and an electromagnet for openably actuating said valve;

said injector being constructed so as to exhibit characteristics which permit ineffective time consumed between start of flowing of an exciting current and actual opening of said valve to converge on a constant value while being gradually reduced with an increase in driving voltage;

a power supply for applying said driving voltage across an exciting coil of said electromagnet of said injector;

said driving voltage being set at a high level enough to permit a ratio of variation of said ineffective time to said driving voltage to be within a tolerance;

an injection command signal generation section for generating an injection command signal of a predetermined signal width at a fuel injection start position; and an injector driving circuit for flowing said exciting current through said exciting coil for a period of time during which said injection command signal is generated.

2. A fuel injection equipment as defined in claim 1, wherein said power supply comprises a generating coil provided in a magneto mounted on the internal combustion engine and a voltage control circuit including a rectifying circuit for rectifying an output of said generating coil and functioning to control said driving voltage.

3. A fuel injection equipment as defined in claim 1, wherein said power supply comprises a generating coil provided in a magneto mounted on the internal combustion engine and a rectifying circuit for rectifying an output of said generating coil.

4. A fuel injection equipment as defined in claim 1, wherein said injection command signal generation section comprises:

a main injection command signal generation section for generating a main injection command signal using a microcomputer;

an auxiliary injection command signal generation section for generating an auxiliary injection command signal when said microcomputer fails to normally operate; and a switching circuit for selecting said signals generated from said main injection command signal generation section and auxiliary injection command signal generation section to generate said injection command signal therefrom.

* * * * *